United States Patent [19]

Visockis

[11] 4,010,950

[45] Mar. 8, 1977

[54] BASEBALL BATTING PRACTICE APPARATUS

[76] Inventor: Joseph N. Visockis, 5204 S. Lorel, Chicago, Ill. 60638

[22] Filed: Jan. 26, 1976

[21] Appl. No.: 652,542

[52] U.S. Cl. ..... 273/26 E

[51] Int. Cl.[2] ..... A63B 69/00

[58] Field of Search ..... 273/25, 26 R, 26 E, 273/29 A, 183 C, 183 D, 200 R, 200 B, 95 R, 95 A

[56] References Cited

UNITED STATES PATENTS

| | | | |
|---|---|---|---|
| 2,606,025 | 8/1952 | Hornig | 273/26 E |
| 2,976,040 | 3/1961 | Bales | 273/26 E |
| 3,454,275 | 7/1969 | Pontone | 273/26 E |
| 3,588,104 | 6/1971 | Griffin | 273/26 E |
| 3,767,198 | 10/1973 | Boyer | 273/26 E |
| 3,830,494 | 8/1974 | Biskup | 273/26 E |
| 3,837,654 | 9/1974 | Hall | 273/200 B X |

*Primary Examiner*—William H. Grieb
*Attorney, Agent, or Firm*—Joel Halpern

[57] ABSTRACT

Baseball batting practice apparatus includes a shaft for detachable connection to a vertical wall and a pair of rotatable gear elements mounted thereon. One of the gear elements is an internal gear and the other gear element is an external gear having a lesser number of teeth and eccentrically mounted so as to mesh with the internal gear in one diametral region. A spring is carried by the shaft and urges the external gear into engagement with the internal gear. A ball is suspended from a hub section which is integral with the internal gear. Striking of the ball causes it to rotate on the hub and effects relative rotation between the gears. Indicia on both of the gears indicates the degree of relative rotation and correlates with the impact force on the batted ball.

5 Claims, 4 Drawing Figures

BASEBALL BATTING PRACTICE APPARATUS

BACKGROUND OF THE INVENTION

The present invention relates to baseball batting practice apparatus and more particularly to apparatus capable of providing an indication as to the effectiveness of the batting stroke.

Baseball batting practice or training devices have been known heretofore. Such prior devices have either involved a rather complex construction such as shown in U.S. Pat. No. 3,588,104 issued June 28, 1971 to Billy J. Griffin in which a variable speed drive mechanism drives a boom arrangement to which the ball is secured or are relatively simple but require a second person who serves as a pitcher. An example of the latter type of prior device is shown in U.S. Pat. No. 3,767,198 issued Oct. 23, 1973 to Ralph C. Boyer. However, a common deficiency of prior devices of the character to which the invention relates is their inability to measure the effectiveness of the batting stroke.

SUMMARY OF THE INVENTION

It is one object of the invention to provide baseball batting practice apparatus which is capable of affording a visual measurement of the effectiveness of the batting stroke.

Another object of the invention is to provide baseball batting practice apparatus which can be easily installed in place and which is of simple construction yet enables the batter to obtain an evaluation of the effectiveness of his batting stroke.

Other objects and advantages of the invention will become readily apparent from the following description of the invention.

According to the present invention there is provided baseball batting practice apparatus comprising:

- a shaft adapted to be fixedly secured at one end thereof to a vertically extending surface;
- an internal gear carried rotatably by the shaft and having an axial hub integral therewith;
- an external gear carried rotatably by the shaft spring-biased into meshing engagement with the internal gear, the external gear having a lesser number of teeth than the internal gear and being mounted eccentrically relative to the internal gear so as to be in meshing engagement therewith through an arc located at one diametral region and in spaced relation to the internal gear at an opposite diametral region;
- spring means for resiliently biasing the external gear axially of the shaft into engagement with the internal gear;
- indicia on the external and internal gears for indicating the degree of rotation of the gears relative to each other;
- and a ball element suspended from the hub of the internal gear.

BRIEF DESCRIPTION OF THE DRAWINGS

In order that the invention may be more fully understood it will now be described, by way of example, with reference to the accompanying drawings in which.

DETAILED DESCRIPTION OF THE INVENTION

Figure 1:
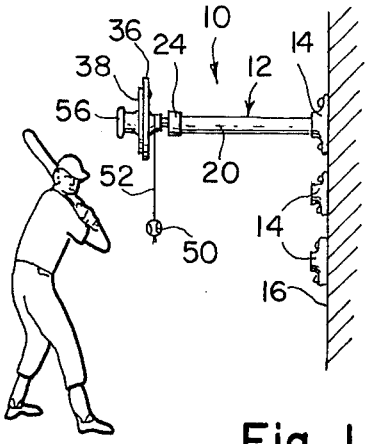
FIG. 1 is a front elevational view of the baseball batting practice apparatus of the invention installed in place showing a batter in position to strike the ball element.

Referring to the drawings there is shown generally, by reference numeral 10, baseball batting practice apparatus. Such apparatus includes a shaft 12 which is provided at one end thereof with a flange 14 located or screwed to a vertically extending surface 16 by means such as screws 18 to properly position the apparatus in place for use.

Figure 2:
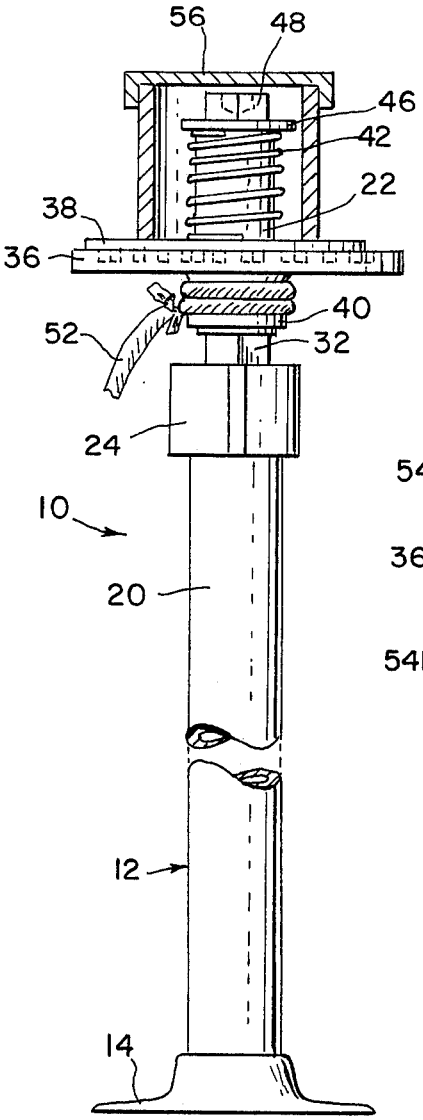
FIG. 2 is a vertical view, partly broken and partly in section, of the shaft and gear arrangement employed in the apparatus.
Figure 4:
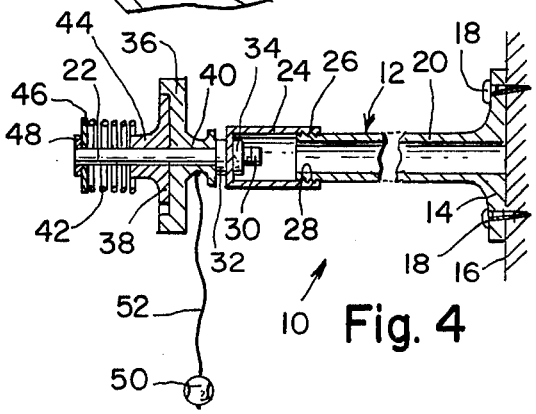
FIG. 4 is a side view, partly broken and partly in section, showing a modified arrangement for the shaft and gearing.

Shaft 12 thus extends inwardly of the wall and, as shown in FIGS. 1, 2 and 4, may comprise two segments 20, 22 connected by means of an adapter or coupling 24. Thus, the end of shaft segment 20 may be provided with an external thread 26 which engages cooperably with an internal thread 28 on the coupling. The second segment 22 of the shaft may also be given a threaded portion 30 which extends through the coupling. A pair of lock nuts 32, 34 secures the second segment of the shaft to the coupling.

A pair of gear elements 36, 38 are mounted rotatably upon shaft segment 22. Gear 36 is an internal gear and is desirably given an axial hub 40 for a purpose to be described. Gear 38 is an external gear and is biased into engagement with gear 36 by means of a coil spring 42 which is secured between the end of hub 44 of gear 38 and a retaining element 46 locked in place on shaft segment 22 by lock nut 48.

Figure 3:
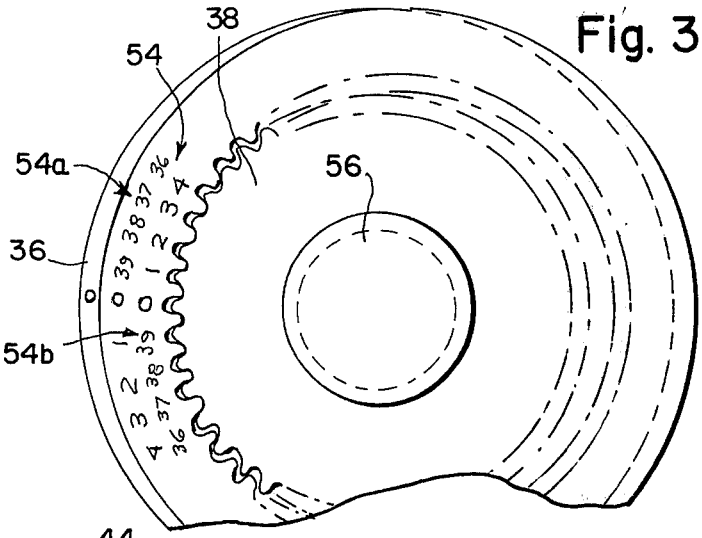
FIG. 3 is an end view of the apparatus showing the cooperable indicia on the gearing.

Gear 38 is mounted eccentrically upon the shaft and is provided with a lesser number of teeth than that of gear 36. Thus, by this construction the gears are in meshing relationship through only relatively small arcuate portions of their peripheries as can be seen most clearly from FIG. 3. This construction also provides for relative rotational movement between the two gears.

A ball element 50 is suspended from the hub 40 of gear 36 preferably by means of a flexible element such as a rope 52. The rope is secured fixedly to hub 40 such that when the ball is batted and is caused to swing in an arc around the shaft gear 36 is caused to rotate and, due to the rotational mounting of gear 38, also effect rotation of the external gear. However, by virtue of the differing number of teeth and the mounting of gear 36 with relation to gear 38 there will be relative rotational movement between the gears. Such relative movement will be representative of the degree of impact with which the ball element is struck by the batter. In order to provide a measurable index of the effectiveness of the batter's stroke gears 36, 38 are provided with indicia 54. It will be observed that two sets of indicia **54*a* and 54*b*** are desirably provided for use respectively by left handed and right handed batters. Such sets are labeled serially in opposite circumferential directions since the ball will be batted so as to rotate about the shaft in opposite directions by such batters. A convenient display of indicia is the provision of an index symbol on the internal gear and concentric sets of reversely numbered values on the external gear.

With regard to the tooth formation on the gears, it has been found that the external gear 38 should desirably be provided with one less tooth than that of gear 36 and that gear 38 be given preferably not more than 45 teeth. However, it will be understood that a greater or lesser number of teeth on the gears may be employed.

By virtue of the spring-biased arrangement of gear 38 it will be appreciated that by manually shifting such gear axially against the influence of spring 42 the gear can be freely rotated so as to reset the indexing of the indicia for the next batting stroke.

In order to make the device more attractive for commercial purposes it will be recognized that a removable end cap 56 may be provided, the gears may be formed of colored plastics material and suitable shield or shroud elements (not shown) may be provided so that the gears are not visible. Such modifications and additions do not alter the basic operational structure of the apparatus and serve only to provide an attractive commercial package.

From the foregoing it will be seen that a baseball batting practice apparatus has been provided which is simple in construction, durable, but which nevertheless, affords means for evaluating the effectiveness of the batting stroke.

I claim:

1. Baseball batting practice apparatus comprising:

a shaft adapted to be fixedly secured at one end thereof to a vertically extending surface;

an internal gear carried rotatably by said shaft and having an axial hub integral therewith;

an external gear carried rotatably by said shaft spring-biased into meshing engagement with said internal gear, said external gear having a lesser number of teeth than said internal gear and being mounted eccentrically relative to said internal gear so as to be in meshing engagement therewith through an arc located at one diametral region and in spaced relation to said internal gear at an opposite diametral region;

spring means for resiliently biasing said external gear axially of said shaft into engagement with said internal gear;

indicia on said external and internal gears for indicating the degree of rotation of said gears relative to each other;

and a ball element suspended from said hub of said internal gear.

2. Baseball batting practice apparatus according to claim 1, wherein said shaft is formed in two segments, the first of said segments having a flange at said one end adapted for detachable connection to a vertically extending surface, the other end of said first segment being threaded, the second of said shaft segments having one end threaded for cooperable threaded engagement with said other end of the first shaft segment, the other end of said second shaft segment carrying a retaining element for said spring means.

3. Baseball batting practice apparatus according to claim 1, wherein said external gear is provided with one tooth less than the number of teeth of said internal gear.

4. Baseball batting practice apparatus according to claim 2, wherein said internal and external gears are mounted on said second shaft segment.

5. Baseball batting practice apparatus according to claim 1, wherein said external gear is provided with not more than 45 teeth.

* * * * *